United States Patent [19]

Kubota et al.

[11] Patent Number: 4,913,379

[45] Date of Patent: Apr. 3, 1990

[54] ROCKET FLIGHT DIRECTION CONTROL SYSTEM

[75] Inventors: Naminosuke Kubota, Yokohama; Yutaka Yano, Tokyo; Yasumasa Takagi, Higashimatuyama; Kazuyoshi Ninomiya; Nobuo Shimoguti, both of Tokyo; Mituhiko Terashima; Tooru Nakano, both of Tokorozawa; Hirohito Ohtsuka, Ohmiya, all of Japan

[73] Assignees: Japan as represented by Director General, Technical Research and Development Institute, Japan Defence Agency, Tokyo; Nissan Motor Co., Ltd., Yokohama, both of Japan

[21] Appl. No.: 313,891

[22] Filed: Feb. 23, 1989

[30] Foreign Application Priority Data

Feb. 23, 1988 [JP] Japan ..... 63-38546
Feb. 23, 1988 [JP] Japan ..... 63-21793[U]

[51] Int. Cl.[4] ..... B64C 15/02

[52] U.S. Cl. ..... 244/52; 244/3.22; 60/230; 239/265.35

[58] Field of Search ..... 244/52, 87, 3.22, 3.21, 244/3.24; 239/265.17, 265.19, 265.33, 265.35; 60/230

[56] References Cited

U.S. PATENT DOCUMENTS

| | | | |
|---|---|---|---|
| 2,995,319 | 8/1961 | Kershner et al. | 244/3.22 |
| 3,286,956 | 11/1966 | Nitikman | 244/3.22 |
| 3,410,505 | 11/1968 | Gilder et al. | 244/3.22 |
| 3,453,828 | 7/1969 | Rawlings | 244/3.22 |
| 4,044,970 | 8/1977 | Maudal | 244/3.22 |
| 4,157,788 | 6/1979 | Canfield et al. | 244/3.22 |
| 4,163,534 | 8/1979 | Seeger | 244/3.22 |
| 4,432,512 | 2/1984 | Young | 244/3.22 |

FOREIGN PATENT DOCUMENTS

| | | | |
|---|---|---|---|
| 320302 | 2/1970 | Sweden | 244/3.22 |
| 827299 | 2/1960 | United Kingdom | 244/3.22 |

*Primary Examiner*—Galen Barefoot
*Attorney, Agent, or Firm*—Foley & Lardner, Schwartz, Jeffery, Schwaab, Mack, Blumenthal & Evans

[57] ABSTRACT

To quickly change rocket flight direction immediately after a rocket has been launched without increasing the wing area, the rocket flight direction control system comprises four steering wings for controlling rocket flight directions; four deflectable nozzles for jetting combustion gas backward to generate rocket thrust; a controller for generating steering control signals; and at least one actuator for actuating the deflectable nozzles in response to the steering control signals in synchronism with steering motion of the steering wings. Further, when the deflectable nozzle is divided into two, fixed and movable, nozzles, the diameter of the outlet end of the fixed divergent nozzle of the overexpansion type nozzle in matched with that of the movable nozzle for prevention of gas leakage through a gap between the two nozzles.

6 Claims, 11 Drawing Sheets

ROCKET FLIGHT DIRECTION CONTROL SYSTEM

BACKGROUND OF THE INVENTION

1. Field of the Invention

The present invention relates generally to a rocket flight direction control system, and more specifically to a system for controlling the flight direction of a rocket by steering wings.

2. Description of the Prior Art

In the prior-art rocket flight direction control systems dependent upon steering wings, there exists a problem in that it is impossible to control a rocket into a low altitude trajectory, immediately after the rocket has been launched off, for instance by quickly turning the rocket direction.

The reason is as follows: even if the initial velocity of the rocket is increased by use of a booster propellant, since the flight velocity is still low immediately after the rocket has been launched off, it is difficult to obtain a sufficient aeromechanical steering force. On the other hand, when the wing area is increased to increase the steering power, since the flight distance decreases with increasing aeromechanical resistance or the rocket is subjected to disturbance such as a side wind, there exists problems in that the rocket trajectory is not kept stable or flight is decreased.

The arrangement of the prior-art rocket flight direction control system will be described in more detail hereinafter with reference to the attached drawings under DETAILED DESCRIPTION OF THE PREFERRED EMBODIMENTS.

SUMMARY OF THE INVENTION

With these problems in mind, therefore, it is primary object of the present invention to provide a rocket flight direction control system by which a rocket flight direction can be quickly controlled, immediately after a rocket has been launched off, without increasing the wing area.

To achieve the above-mentioned object, a rocket flight direction control system for a rocket including a rocket body and a combustion chamber, according to the present invention, comprises: (a) steering wing means, pivotally provided on the rocket body, for controlling rocket flight directions; (b) deflectable nozzle means, deflectively provided on the rocket body, for jetting combustion gas from the combustion chamber back to generate rocket thrust; (c) control means, mounted in the rocket body, for generating steering control signals; and (d) actuating means, coupled to said steering wing means, said deflectable nozzle means and said control means, for actuating said deflectable nozzle means in response to the steering control signals in synchronism with steering motion of said steering wing means.

The respective steering wing means and the respective deflectable nozzle means can be actuated simultaneously by a single or two separate actuating units.

Further, the deflectable nozzle means is preferably divided into two, fixed and movable, nozzle means. Further, it is also possible to fix the steering wing means to the movable nozzle. Furthermore, when the fixed nozzle means is a divergent nozzle of the overexpansion type, it is also preferable to match the diameter of the outlet end of the divergent nozzle means with that of the movable nozzle means to prevent combustion gas from leaking from a gap formed between the two, fixed and movable, nozzle means.

In the control system according to the present invention, since each of the nozzles can be actuated together with the corresponding steering wings in response to steering control signals, it is possible to set the thrust axis to the steering direction, that is, to increase the steering force along the steering direction. Therefore, it is possible to quickly turn the rocket flight direction even at low speeds or at low altitude.

DETAILED DESCRIPTION OF THE PREFERRED EMBODIMENTS

To facilitate understanding of the present invention, a reference will be made to prior-art rockets, with reference to the attached drawings.

Figure 1A:
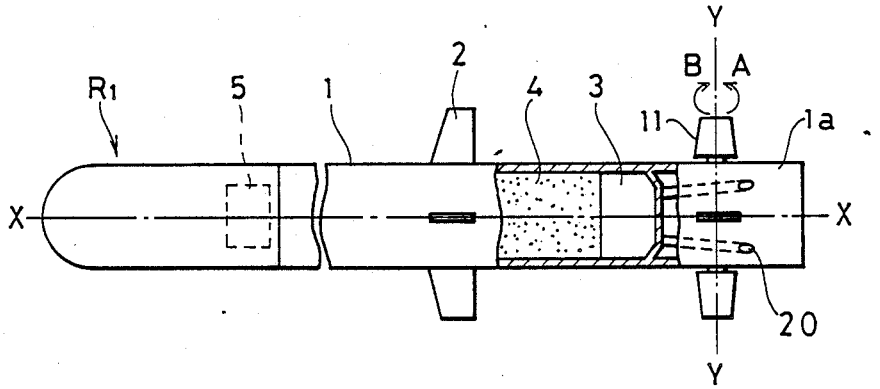
FIG.1(A) PRIOR ART
FIG. 1(A) is a partially cross-sectional side view showing the essential portion of a basic prior-art rocket structure.

FIG. 1(A) shows a prior-art basic rocket structure. The rocket R1 comprises a rocket body 1, four fixed stabilizing wings 2 arranged at regular angular intervals to the tail side from the middle of the rocket body 1, four pivotal steering wings 11 arranged also at regular angular intervals at a tail pipe 1*a*, four rocket nozzles 20 symmetrically arranged at an inclination angle with respect to the rocket axis X—X, a combustion chamber 3 filled with a solid rocket propellant 4, and a controller 5. The rocket R1 can fly at a relatively low speed by jetting high temperature combustion gas obtained by a solid propellant 4 of the end surface combustion type, for instance, charged in the combustion chamber 3, through the four rocket nozzles 20. Further, the respective selected steering wing 11 is pivoted in the forward or reverse direction (i.e. clockwise or counterclockwise) about the central steering axis Y—Y, as shown by arrows A and B, in response to steering signals transmitted by the controller 5. Therefore, the rocket flight direction can be controlled by applying three (yaw, pitch and roll) axial moments to the rocket body 1 in cooperation with all four steering wings 11.

Figure 1B:
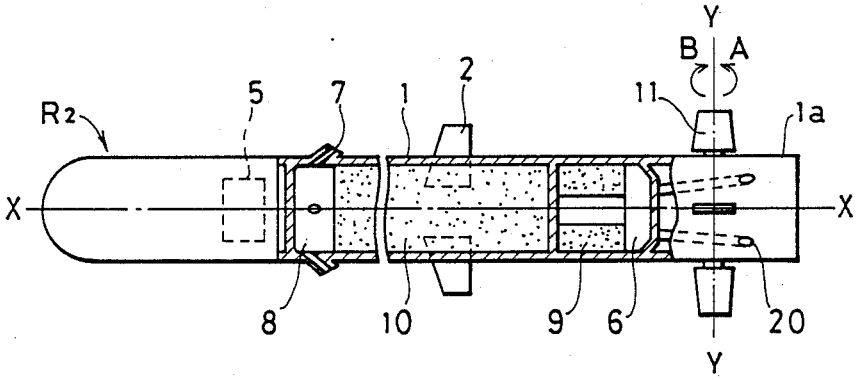
FIG.1(B) PRIOR ART
FIG. 1(B) is a partially cross-sectional side view showing the same essential portion of another basic rocket structure.
Figure 1:
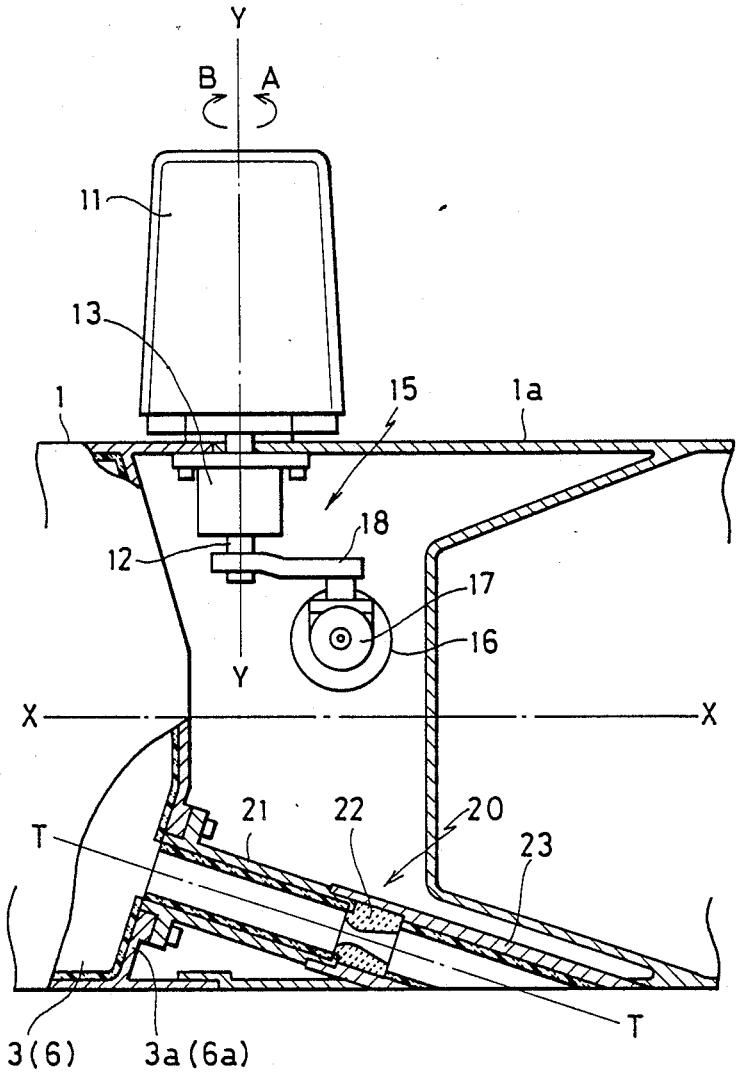
FIG.1 (C) PRIOR ART
FIG. 1(C) is an enlarged cross-sectional view showing the essential portion of the wing and the nozzle unit of the prior-art rocket.

FIG. 1(B) shows another prior-art basic rocket structure. This rocket R2 comprises the rocket body 1, the stabilizing wings 2, the controller 5, the steering wings 11, the rocket nozzles 20, in the same way as in FIG. 1(A), and additionally a booster combustion chamber 6 communicating with the rocket nozzles 20 (i.e. booster nozzles) within the rocket body 1, and a sustainer combustion chamber 8 communicating with four sustainer nozzles 7 arranged on the front side of the middle of the rocket body 1. Further, the combustion chamber 6 is filled with a booster propellant 9 of the inner surface combustion type, for instance and the combustion chamber 8 is filled with a sustainer propellant 10 of the end surface combustion type, for instance. The booster propellant 9 is burnt away within a predetermined time period after the rocket has been launched off to accelerate the rocket to a predetermined speed, and thereafter the combustion gas obtained by the sustainer propellant 10 is jetted through the sustainer nozzles 7 to keep the rocket flying at a relatively low speed. Further, the flight direction thereof can be controlled in the same way as in FIG. 1(A).

FIG. 1(C) shows an enlarged cross-sectional view showing one steering mechanism and one rocket nozzle 20. The steering mechanism includes the steering wing 11, a steering axle 12 fixed to the wing 11 and arranged along the central steering axis Y—Y perpendicular to the axis X—X of the tail pipe 1*a*, a bearing 13 fixed to the tail pipe, and a steering wing actuator 15 composed of a servomotor 16 rotated in the forward or reverse direction in response to steering signals such as positive and negative pulse signals proportional to a required steering angle and supplied from the controller 5, a ball screw member 17 for converting the rotational motion of the servomotor 16 to linear motion, and an arm 18 fixed to the steering axle 12 to pivot the axle 12 in the forward or reverse direction in linkage with the converted linear motion. Further, when the respective steering wing 11 is pivoted in either direction in response to the steering signals, the pivotal angle of the steering wing 11 is detected by a potentiometer (not shown) and then feedbacked to the controller 5 to control the steering wing 11 at a required steering angle in a feedback control method.

Further, the rocket nozzle 20 includes a duct pipe 21 fixed to the rear end wall 3*a* (or 6*a*) of the combustion chamber 3 (or the booster combustion chamber 6), a nozzle insert unit 22 disposed at the rear end of the duct pipe 21, and a nozzle extension 23 fixed to the duct pipe 21 to support the nozzle insert unit 22 and opened toward outside the tail pipe 1*a*. Further, the thrust axes T—T of the four rocket nozzles 20 are arranged at regular angular intervals about the rocket body axis X—X so as to be open toward the back. Therefore, the resultant thrust axis of these rocket nozzles 20 matches the rocket body axis X—X.

In the above-mentioned prior-art rocket flight direction control system dependent upon only the steering wings, there exists a problem in that it is impossible to control the rocket along a low altitude trajectory, immediately after launching off, by quickly turning the rocket, as already described hereinbefore under Description of the Prior Art.

In view of the above description, reference is now made to a first embodiment of the control system according to the present invention.

Figure 2A:
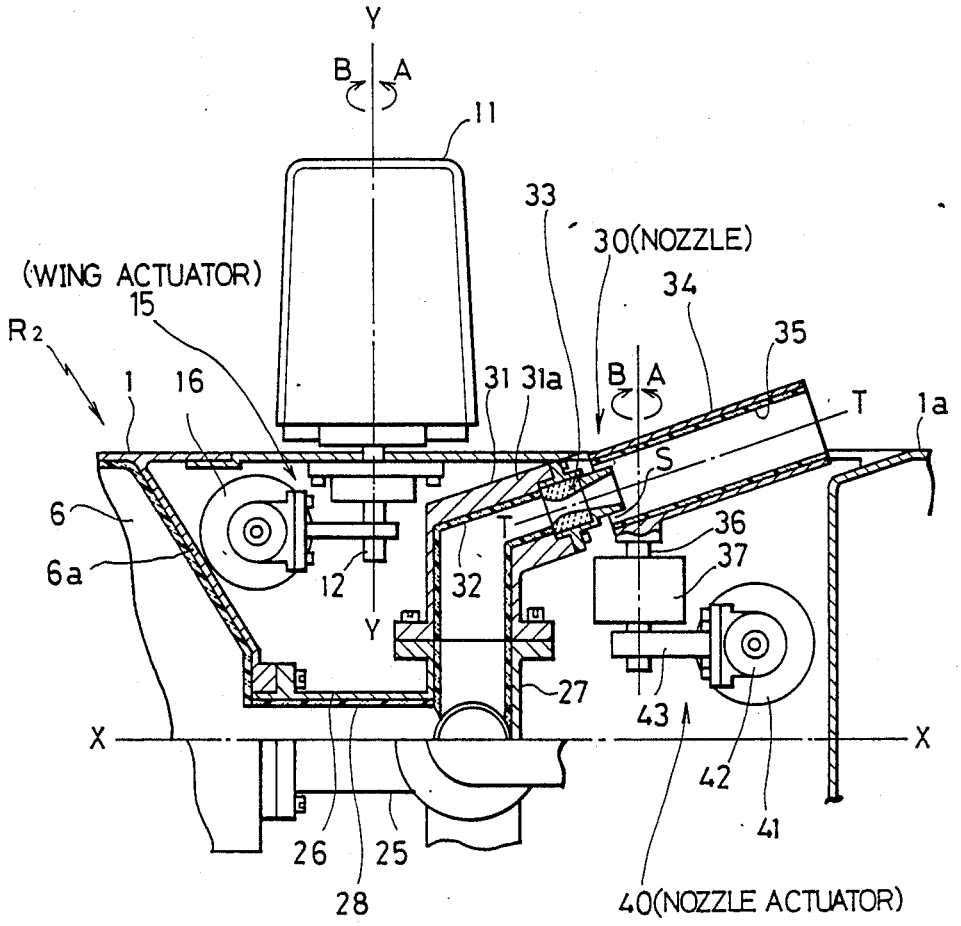
FIG. 2(A) is a cross-sectional view showing the essential portion of a first embodiment of the rocket flight direction control system according to the present invention.

In FIG. 2(A), the rocket R2 comprises the steering wings 11 and the steering wing actuators 15 in the same way as that shown in FIG. 1(C), and further includes novel rocket nozzles 30 and nozzle actuators 40 (only one of them is shown). Therefore, the flight direction of the rocket can be controlled by the servomotor 16 actuated in response to the steering signals, in the same way as in the prior-art system.

On the other hand, a manifold 25 is composed of a main duct 26 and four branch ducts 27 branched off from the rearmost end of the main duct 26 at a right angle. The front end of the main duct 26 is fixed to the central portion of the rear end wall 6*a* of the booster combustion chamber 6, and each branch duct 27 is directed to the steering wing axis Y—Y. Further, a heat resistant insulator 28 (e.g. graphite) is attached onto the inner surface of the manifold 24, and a rocket nozzle 30 is fixed to each branch duct 27, respectively.

In more detail, a rocket nozzle 30 includes an angled duct pipe 31, a fixed nozzle insert unit 33 fixed to an end of the bent outer portion 31*a*, and a movable nozzle extension 34, an extension support shaft 36, and a bearing 37. The inner end portion of the angled duct pipe 31 is fixed to the branch duct 27 and the outer portion 31*a* thereof is bent toward the back at an inclination with respect to the body axis X—X.

The common central axis (thrust axis T—T) of the fixed nozzle insert unit 33, the bent outer portion 31*a* and the movable nozzle extension 34 is located on the same plane including the central steering axis Y—Y and the rocket body axis X—X. Further, the nozzle extension 34 is overlapped with the nozzle insert unit 33 on the rear side with a gap S therebetween. The extension support shaft 36 is fixed to the nozzle extension 34 so that the axis of the shaft 36 is in parallel to the central steering axis Y—Y. This shaft 36 is supported by the tail pipe 1*a* via the bearing 37. Further, heat resistant insulators 32 and 35 are attached to the inner surfaces of the duct pipe 31 and the nozzle extension 34, respectively.

A nozzle actuator 40 includes a servomotor 41, a ball screw member 42, and an arm 43. The servomotor 41 rotates in the forward or reverse direction in response to positive or negative steering signals supplied from the controller 5. The ball screw member 42 converts the rotational motion of the servomotor 41 into the linear motion. The arm 43 fixed to the support shaft 36 is pivoted in the forward and reverse directions in linkage with the linear motion of the ball screw member 42, (see FIG. 2(B) for reference).

As described above, each of the four steering wings 11 and each of the four rocket nozzles 30 are arranged on the same plane including the rocket body axis X—X.

In operation, high temperature combustion gas obtained by the booster propellant 9 is passed through the manifold 25, divided into four rocket nozzles 30, and then jetted toward the back at an inclination angle, so that a resultant thrust force can be generated in the body axis (X—X) direction as with the case of the prior-art rocket. Under neutral conditions, when a positive steering signal, for instance is supplied from the controller 5 to the servomotor 16 of the steering wing actuator 15, the servomotor 16 is rotated in the forward direction to pivot the steering wing 11 in the arrow direction A. Simultaneously, since the same positive steering signal is supplied from the controller 5 to the servomotor 41 of the nozzle actuator 40, the motor 41 is also rotated in the forward direction to deflect the nozzle extension 34 in the same arrow direction A via the support axle 36 in synchronism with the steering (i.e. pivotal) motion of the steering wing. That is, since the thrust axis T—T of the nozzle extension 34 can be deflected in the arrow direction A, it is possible to increase the steering force of the steering wing 11 by a component force of the rocket nozzle thrust.

As described above, it is possible to quickly change the rocket flight direction within a low speed range immediately after the rocket has been launched off. In this case, although the booster propellant 9 is soon burnt away, since the rocket has been accelerated sufficiently to a high speed at that time, the rocket flight direction can be controlled by only the steering wings 11. Further, after the booster rocket nozzles 30 have been used, it is possible to stop supplying steering signals to the servomotor 41. In the above first embodiment, the control system has been applied to the rocket R2 as shown in FIG. 1(B), in which the booster combustion chamber 6 is provided. However, it is of course possible to supply the control system of the present invention to the rocket R1, as shown in FIG. 1(A), in which the booster combustion chamber is not provided. In this case, it is possible to use the steering wing actuator 15 and the nozzle actuator 40 in common without stopping steering signals, even after the rocket has been accelerated.

Figure 2B:
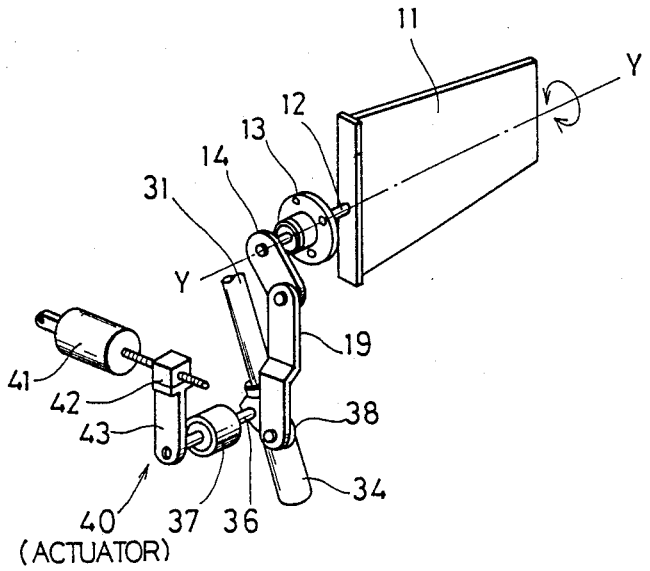
FIG. 2(B) is a perspective view showing the essential portion of a modification of the first embodiment shown in FIG. (2A)

FIG. 2(B) shows a modification of the first embodiment of the above-mentioned structure. In this drawing, an arm 38 is coupled to the nozzle extension 34 driven by the nozzle actuator 40, and further another arm 14 is fixed to an inner end of the steering axle 12 in such a way that each free end of the two arms 38 and 14 can be linked by a link lever 19 via two pins.

In operation, when the nozzle extension 34 is deflected by the servomotor 41, the steering wing 11 is also pivoted in the same direction because the nozzle motion is transmitted to the steering wing 11 via the arm 38, the link lever 19 and the arm 14.

Figure 3:
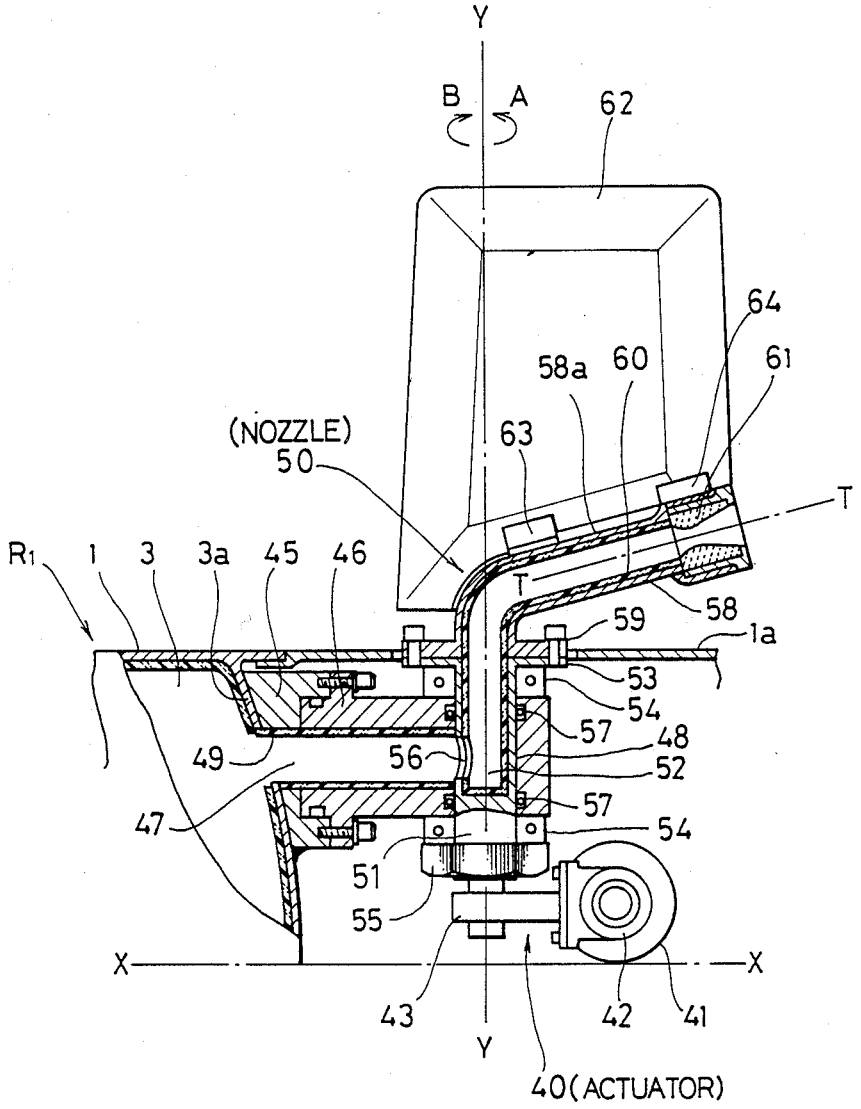
FIG. 3 is a cross-sectional view showing the essential portion of a second embodiment of the rocket flight direction control system according to the present invention.

FIG. 3 shows a second embodiment of the present invention, which can be applied to the rocket R1 provided with no booster chamber shown in FIG. 1(A). In this embodiment, four nozzle bases 45 are fixed at regular angular intervals to the rear end wall 3*a* of the combustion chamber 3, and further a holder block 46 is airtightly fastened to each of these nozzle bases 45. The nozzle base 45 and the holder block 46 form a straight gas passage 47 whose front end communicates with the combustion chamber 3 and whose rear end is closed. Further, a nozzle support hole 48 perpendicular to the body axis X—X is formed at the rearmost end of the holder block 46 so as to communicate with the gas passage 47 via the hole 56. A heat resistant insulator 49 is also attached to the inner surface of the gas passage 47.

The rocket nozzle 50 is mainly composed of a support axle 51, a movable angled duct pipe 58, and a nozzle insert unit 61. The support axle 51 is formed with an inner cavity 52 extending radially outward, and a flange 53 formed at the outer end. The support axle 51 is fitted to the support hole 48 of the holder block 46 and supported by two thrust bearings 54. Further, a nut 55 is screwed around a threaded portion of the radially inner end of the support angle 51 to pivotally locate the support axle 51 in position. Further, the gas passage 47 communicates with the inner cavity 52 via a hole 56 formed in the support axle 51, and two sealing ring members 57 are airtightly disposed between the support member 51 and the holder block 46.

The movable angled duct pipe 58 is formed with a flange 59 fixed to the flange 53 of the support axle 51 and with a bent inclination portion 58*a* extending from near the flange 59 at an inclination angle back outside the tail pipe 1*a*. The nozzle insert unit 61 is fixed to the outlet end of this bent inclination portion 58*a* coaxially with the thrust axis T—T. Further, a heat resistant insulator 60 is attached to the inner surface of the movable duct pipe 58.

The nozzle actuator 40 is linked with the inner end of the support axle 51 to pivot the rocket nozzle 50 in the forward and reverse directions by the servomotor 41. Further, the inner end surface of the steering wing 62 is fixed to the bent inclination portion 58*a* of the duct pipe 58 via two metallic wing fixing members 63 and 64, so that the steering wing 62 can be pivoted about the central steering axis Y—Y of the support axle 51.

In this second embodiment, since the rocket nozzle 50 is formed integral with the steering wing 62, and further the nozzle 50 and the steering wing 62 can be driven by the common nozzle actuator 40, there exists an advantage that the structure is simplified without use of any link mechanism as shown in FIG. 2(B).

Figure 4:
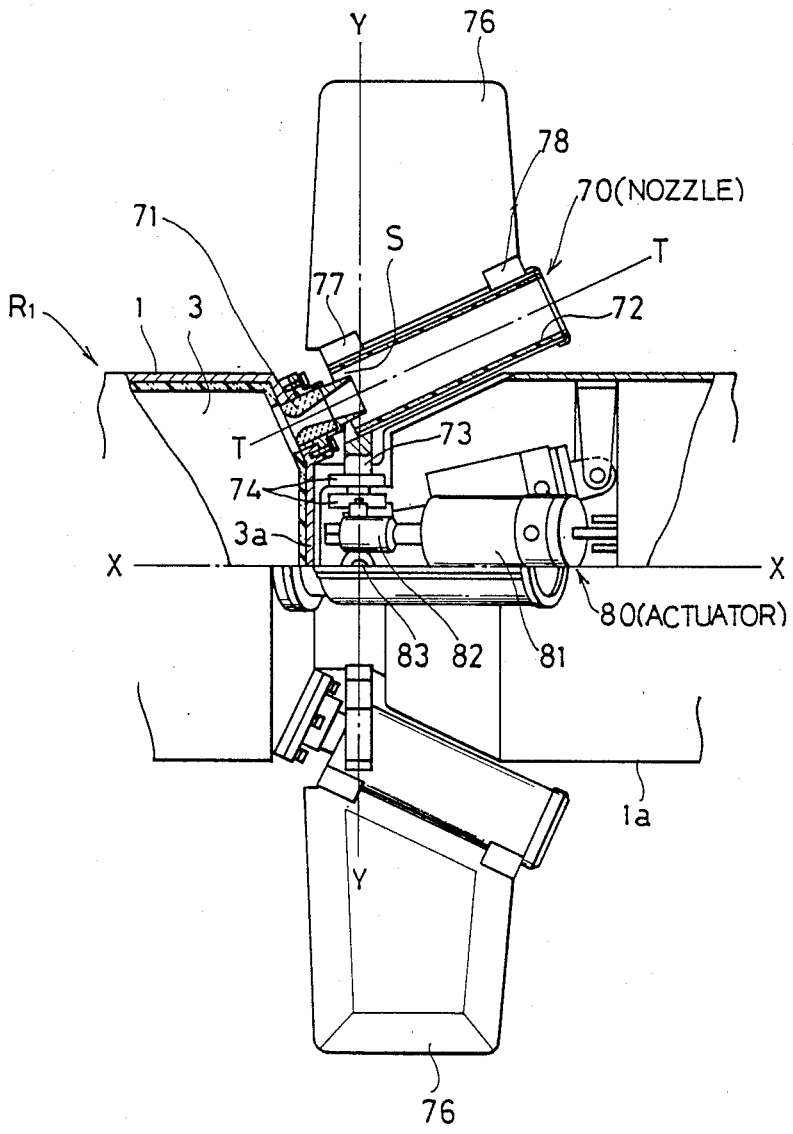
FIG. 4 is a cross-sectional view showing the essential portion of a third embodiment of the rocket flight direction control system according to the present invention.

FIG. 4 shows a third embodiment of the present invention, which comprises rocket nozzles 70 each composed of a fixed nozzle insert unit 71 and a movable nozzle extension 72. The four nozzle insert units 71 are fixed to the rear end wall 3*a* of the combustion chamber 3 at regular angular intervals so as to extend back at an inclination angle with respect to the rocket body axis X—X. Each end of the four movable nozzle extensions 72 is fixed to a radially outer end of a support axle 73 arranged perpendicular to the body axis X—X and supported by the tail pipe 1*a* via a bearing 74, and located coaxial with the thrust axis T—T of the nozzle insert unit 71, with a gap S between the two, fixed and movable nozzles 71 and 72.

Each steering wing 76 is fixed to each nozzle extension 72 with two wing fixing members 77 and 78. The radially inner end of the support axle 73 is linked with the nozzle actuator 80 to pivot the steering wing 76 and the movable nozzle extension 72 together about the support axis 73 (i.e. the central steering axis Y—Y).

The nozzle actuator 80 comprises a servomotor 81 whose axis is arranged in parallel to the body axis X—X and rotated in the forward and reverse directions in response to the steering signals, a ball screw member 82 for converting the rotational motion into linear motion, and an arm 83 fixed to the support axle 73 and pivoted in the forward and reverse directions in linkage with the linear motion, which is similar to the former embodiments.

In this third embodiment, since the combusiton gas passage directly communicates with each nozzle insert unit 71 via no bent portion, the gas jet efficiency is high. Further, since the servomotor 81 can be arranged compactly around the body axis X—X, it is possible to minimize the element arrangement space.

Figure 5:
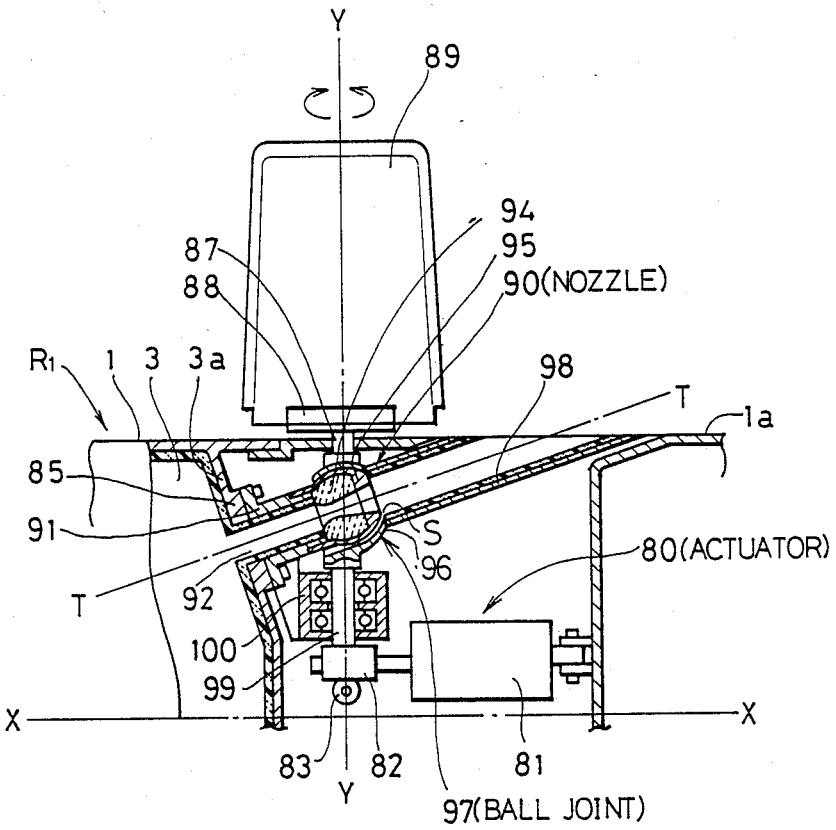
FIG. 5 is a cross-sectional view showing the essential portion of a fourth embodiment of the rocket flight direction control system according to the present invention.

FIG. 5 shows a fourth embodiment of the present invention, in which four rocket nozzles 90 are fixed to four nozzle base 85 arranged at regular angular intervals on the rear end wall 3a of the combustion chamber 3.

A duct block 91 formed with a gas passage 92 extending back at an inclination angle is fixed to the nozzle base 85. Each nozzle 90 is fixed to the duct block 91 coaxially with the central axis of the duct block 91 (i.e. the thrust axis T—T).

The nozzle 90 comprises a nozzle insert unit 94 formed with a spherical outer surface, and a ball joint mechanism 97 including a ball stud (spherical bead portion) 95 fitted to the rear end of the duct block 91 so as to cover the nozzle insert unit (made of graphite, for instance) 94 and a ball socket 96 for covering this ball stud 95.

A movable nozzle extension 98 is fixed to the radially outer circumferential surface of the ball socket 96 coaxially with the thrust axis T—T so as to be directed toward the outside of the tail pipe 1a. The ball socket 96 is supported by a support axle 99 extending perpendicular to the body axis X—X. This support axle 99 is supported by the tail pipe 1a via the bearing 100. Further, the inner end of the support axle 99 is linked with the nozzle actuator 80 to pivot the support axle 99 in the forward and reverse directions. Further, the steering wing 89 is fixed to an outer end of a steering axle 87 extending from the ball socket 96 coaxially with the support axle 99 (i.e. the central steering axis Y—Y) via a wing fixing member 88.

In this fourth embodiment, since the movable nozzle extension 98 is pivoted with the ball joint mechanism 97 as a node, the deflection range is not limited by the gap S, as is the case in the embodiments shown in FIGS. 2(A) and 4. That is, it is possible to more effectively control the rocket flight direction by greatly deflecting the thrust axis T—T together with the steering direction.

Figure 6A:
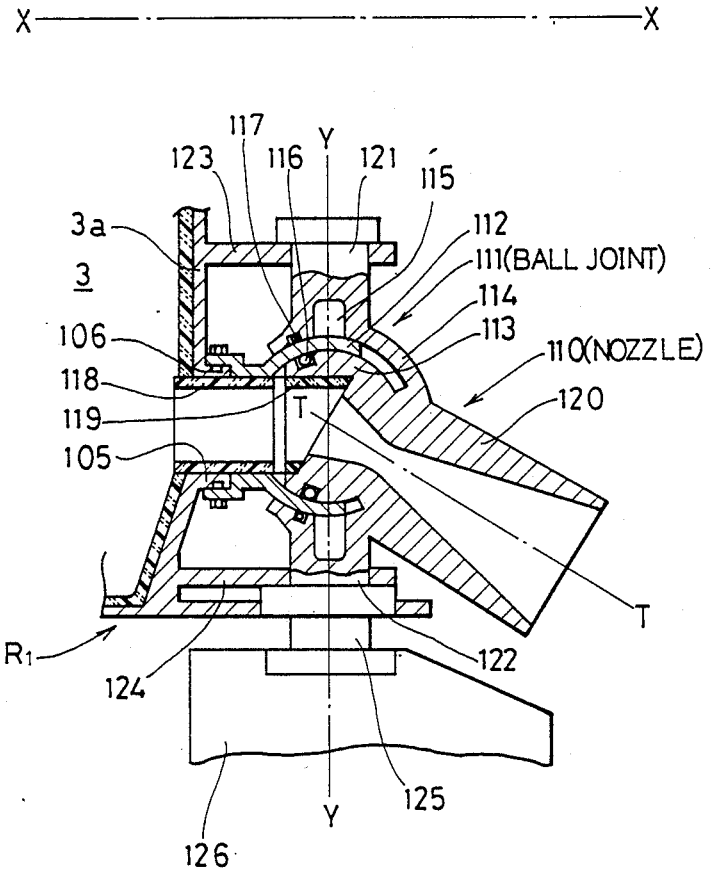
FIG. 6(A) is a cross-sectional view showing the essential portion of a fifth embodiment of the rocket flight direction control system according to the present invention.

FIGS. 6(A) and (B) show a fifth embodiment, in which four embosses 105 extending parallel with the body axis X—X are formed at regular angular intervals on the rear end wall 3a of the combustion chamber. Each rocket nozzle 110 comprises a fixed ball socket 112 airtightly fixed to the emboss 105 via a sealing ring 106 and extending back and a movable nozzle unit 120 oscillatable by a ball joint mechanism 111 in cooperation with the ball socket 112. In this ball joint mechanism 111, roughly the half front portion of the ball stud 113 formed at the front end of the movable nozzle unit 120 is covered by the ball socket 112 so as to be resistant against thrust. Further, a cell portion 114 extending from the nozzle unit 120 is slightly caulked so as to be brought into contact roughly with the entire outer spherical surface of the ball socket 112, in order that the nozzle unit 120 is not removed from the ball socket 112. In the drawing, the nozzle unit 120 is formed with two cavities 115 for facilitating the caulking work.

The movable nozzle unit 120 is further formed with two coaxial support axles 121 and 122 extending from both sides of the cell portion 114 in the direction perpendicular to the body axis X—X in such a way that the thrust axis T—T of the nozzle unit 120 is obliquely directed back on the plane including the rocket axis X—X. These two support axles 121 and 122 are supported by the rear end wall 3a via two support plates 123 and 124.

Further, seal rings 116 and 117 are disposed between the ball socket 112 and the nozzle unit 120, and further heat resistant insulators 118 and 119 are attached to the inner surfaces of the ball socket 112 and the ball stud 113, respectively. Further, a steering wing 126 is fixed to a steering axle 125 extending outward from the support axle 122.

Figure 6B:
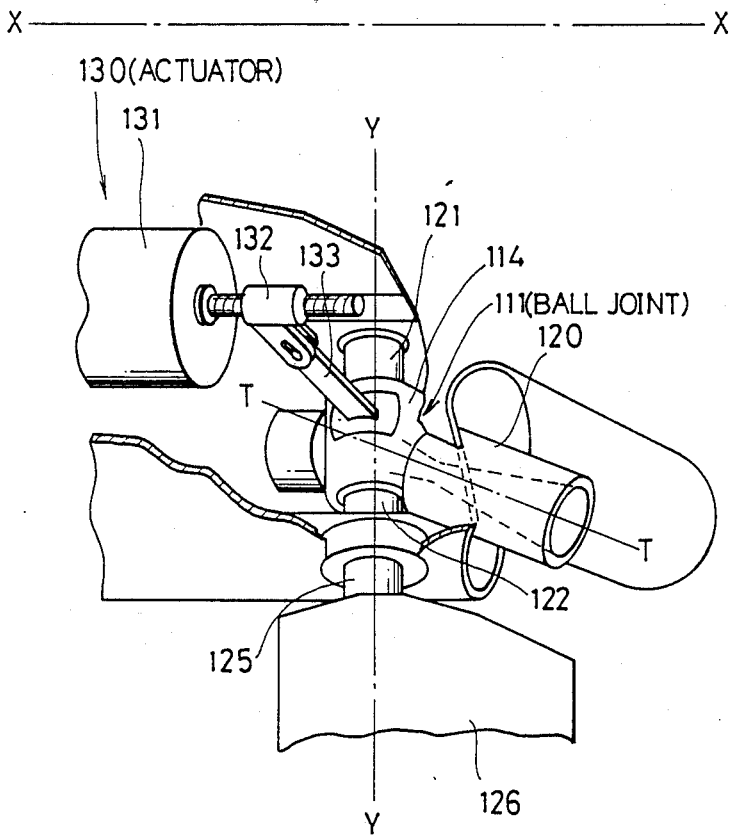
FIG. 6(B) is a perspective view showing the essential portion of the fifth embodiment shown in FIG. 6(A), obtained when seen from a different vantage point.

FIG. 6(B) shows a nozzle actuator 130 of this fifth embodiment seen from a different vantage point, which comprises a servomotor 131, a ball screw member 132, and an arm 133 fixed to the cell portion 114 so as to extend at a right angle from the axis (the central steering axis Y—Y) of the two support axles 121 and 122. As already explained, when the servomotor 131 rotates in the forward and reverse directions in response to the steering signals, the ball screw means 132 moves to drive the arm 133 in the forward and reverse directions. Therefore, an assembly of the movable nozle unit 120 and the steering wing 126 is pivoted about the central steering axis Y—Y with the ball joint mechanism 111 as a node. In this embodiment, since the movable nozzle unit 120 can directly be pivoted without use of the nozzle extension, the deflection angle of the nozzle always matches that of the thrust axis T—T, so that it is possible to facilitate calculations executed by the controller 5.

As described above, in the system according to the present invention, since the corresponding rocket nozzle can be deflected together with the steering wing, it is possible to sharply change the rocket flight direction even when the rocket is flying at relatively low speed, or immediately after the rocket has been launched off.

Figure 7A:
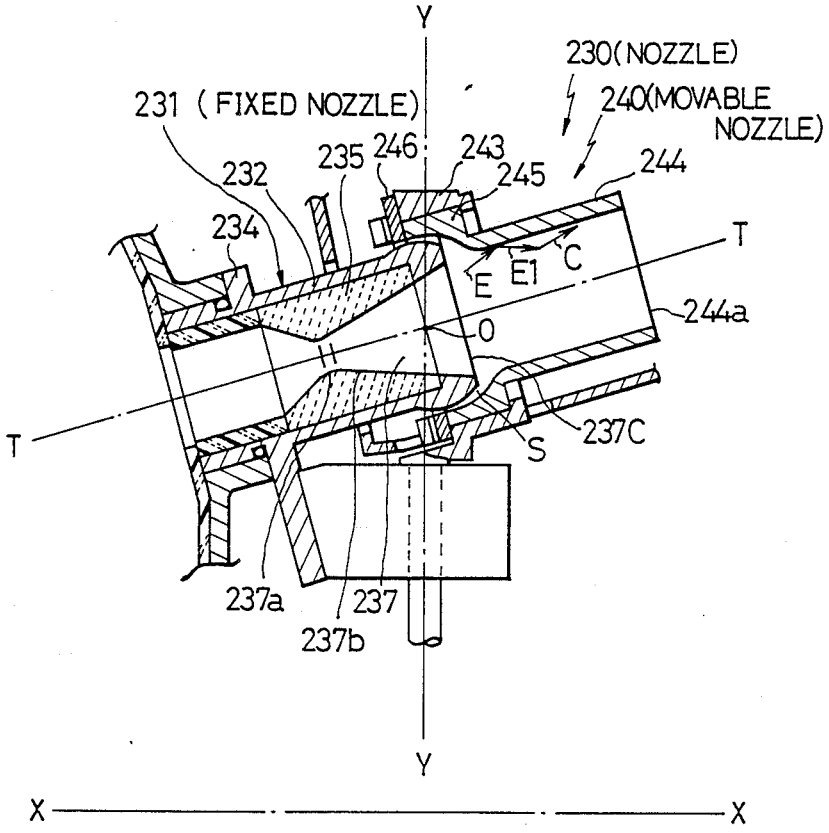
FIG. 7(A) is a cross-sectional view showing a first modification of a rocket nozzle incorporated in the control system according to the present invention.

FIGS. 7(A) and (B) show a modification of a rocket nozzle incorporated in the control system according to the present invention.

In FIG. 7(A), a movable nozzle 240 is ordinarily located at the neutral position relative to the fixed nozzle 231. Under these conditions, when the propellant is ignited to launch the rocket, high temperature combustion gas is charged in the combustion chamber into a high pressure, uniformly divided into each duct 234, expanded along the divergent portion 237b of the nozzle hole 237, and then jetted from the fixed nozzle outlet end 237C at high speed, so that a thrust is generated in the thrust axis (T—T) direction. Thereafter, the jet gas is introduced into the cylindrical nozzle body 244 of the movable nozzle 240 to determine the jet directivity, and then jetted from the movable nozzle outlet end 237C in such a way that the resultant thrust vector of the four rocket nozzles 230 matches the rocket body axis X—X.

In the rocket nozzle 230 shown in FIG. 7(A), since there exists a gap S between the fixed divergent nozzle and the movable cylindrical nozzle, a large quantity of the combustion gas leaks therethrough, thus resulting in a problem in that other elements (e.g. actuators, transmission mechanisms, etc.) are contaminated or damaged. Therefore, it has been necessary to protect the elements from the leaked combustion gas.

The reason why the combustion gas leaks through the gap S will be described in more detail hereinbelow.

In general, the divergent nozzle is designed into an optimum expansion type nozzle in which the nozzle aperture ratio (outlet area/throat area) is determined so that the jet gas pressure at the nozzle end becomes equal to the external pressure, in accordance with Bernoulli's theory, in order to obtain the maximum thrust performance. In comparison with the optimum expansion type nozzle, when the outlet pressure decreases below the external pressure, the nozzle is called an overexpansion type nozzle; when the outlet pressure increases beyond the external pressure, the nozzle is called the underexpansion type nozzle. Therefore, if the optimum expansion condition is established in consideration of a low altitude or the ground, since the nozzle becomes the underexpansion type at a high altitude or under a low pressure, the thermal efficiency drops. Therefore, when the rocket performance is optimized at a high altitude, the nozzle is the overexpansion type at the ground level. When the overexpansion rate is excessive, since expansion waves are reflected as compression waves from the free boundary between the gas and the atmosphere at a low altitude, the jet gas is compressed down to the external pressure as compressed gas flow. In this case, since the structure of the divergent nozzle is formed so as to easily receive the compression wave from the outlet end, the compressed gas tends to flow back deep into the nozzle and away from the divergent portion. Under these conditions, the nozzle performance is markedly deteriorated. In other words, there exists a limit to the overexpansion rate.

On the other hand, in the case of the movable nozzle, since the jet gas passed through the divergent nozzle is immediately introduced into the movable nozzle and further expanded while passing through the movable nozzle due to the inertia, the prior-art divergent nozzle is formed into the underexpansion type, and further the lack of expansion is compensated for by increasing the diameter of the movable nozzle. As described above, in the prior-art divergent nozzle, since the outlet pressure of the divergent nozzle always exceeds the external pressure, the jet gas leaks through the gap S shown in FIG. 7(A). In addition, since a sufficient nozzle deflectable space is required near the movable nozzle, there exists a limit of the diameter of the movable nozzle. Further, whenever the movable nozzle is deflected, since the gas flow direction changes violently immediately after the jet gas has been introduced into the movable nozzle, the pressure further increases so that the amount of gas leaked through the gap S is also increased.

To overcome the above-mentioned problem, the rocket nozzle according to the present invention is characterized in that the fixed divergent nozzle is formed dinto an overexpansion type nozzle and the outlet diameter of the movable nozzle is formed so as to be equal to or a little smaller than that of the fixed divergent nozzle.

In the above-mentioned nozzle, since the fixed divergent nozzle is formed into an overexpansion type nozzle and therefore the outlet pressure of the nozzle drops below the external pressure, it is possible to prevent the gas from leaking through the gap S. In addition, since the jet gas from the outlet of the fixed divergent nozzle is immediately introduced into the movable nozzle being separated from the external pressure by the inner circumferential wall of the movable nozzle, even when the overexpansion rate is determined to be sufficiently high, the gas will not be separated away from the divergent portion of the fixed nozzle.

On the other hand, the expansion wave of the overexpansion jet gas introduced into the movable nozzle is reflected again from the circumferential wall of the movable nozzle as expansion waves, being directed toward the outlet side of the movable nozzle by enclosing the central gas flow, as depicted by zigzag lines in FIG. 7(A). In this case, since the outlet diameter of the fixed divergent nozzle is determined to be equal to that of the movable nozzle, the jet gas flow is converged into the initial jet condition to restrict the further overexpansion flow.

With reference to FIG. 7(A) again, the rocket nozzle construction is basically the same as shown in FIG. 5. The nozzle insert unit 235 of the fixed divergent nozzle 231 is made of a heat resistant material (e.g. graphite), and includes a nozzle throat portion 237*a* and a divergent portion 237*b* of the nozzle hole 237. The aperture ratio (the outlet area/throat area) is determined so that the nozzle becomes of is the overexpansion type nozzle over all the altitudes at which the rocket flies.

The cylindrical nozzle body 244 of the movable nozzle 240 is made of an ultrahigh heat resistant material (e.g. tungsten, molybdenum, fine ceramics, etc.). The diameter of the outlet end 244*a* of the nozzle body 244 is determined to be equal to (as shown in FIG. 7(A)) or a little smaller than that of 237C of the fixed divergent nozzle 231. Further, in FIG. 7(A), the reference numeral 246 denotes a cotter plate 246 disposed on the front end surface of a retainer 243 to fix the socket portion 245 to the retainer 243.

To verify the effect of the nozzle shown in FIG. 7(A), the nozzle was mounted on a rocket motor and observed by schilieren photographs. Under the neutral position, the amount of leakage gas was very small. When the deflection angle was about 12 degrees, the amount of leakage gas increased a little, which was markedly reduced as compared with the prior-art nozzle, without developing any practical problems. The above-mentioned gas leakage may be due to the fact that the gas pressure is increased when the outermost circumferential portion of jet gas flows through the discontinuous portion between the nozzle hole 237 and the nozzle body 244, and further increased when the gas flow is deflected.

The experiment has indicated that a high thrust performance can be obtained when the length of the nozzle body 244 is determined to be 1.0 to 1.5 times longer than the outlet diameter of the nozzle hole 237. The reason can be explained as follows: the overexpanded gas wave E is reflected from the inner circumferential surface of the nozzle body 244 as expansion wave E1. Further, when this expansion wave E1 collides with the free boundary to the central gas flow, the wave E1 is reflected again as compression wave C, as shown in FIG. 7(A). Therefore, if the length of the nozzle body 244 is determined as described above, this compression wave C just reaches the outlet end 244*a* of the movable nozzle 240, so that pressure is restored.

Further, in the movable nozzle 240, since only the nozzle body 244 (which is directly exposed to high temperature combustion gas) can be formed into a single element, it is possible to facilitate the shape and manufacturing method. In other words, it is possible to make the nozzle body 244 by metallic materials difficult to machine (e.g. tungsten, molybdenum, etc.) or nonmetallic material difficult to mold (e.g. fine ceramics, etc.). As a result, it is impossible to manufacture the movable nozzle excellent in heat resistance, by using a high costly material for only a limited portion.

Figure 7B:
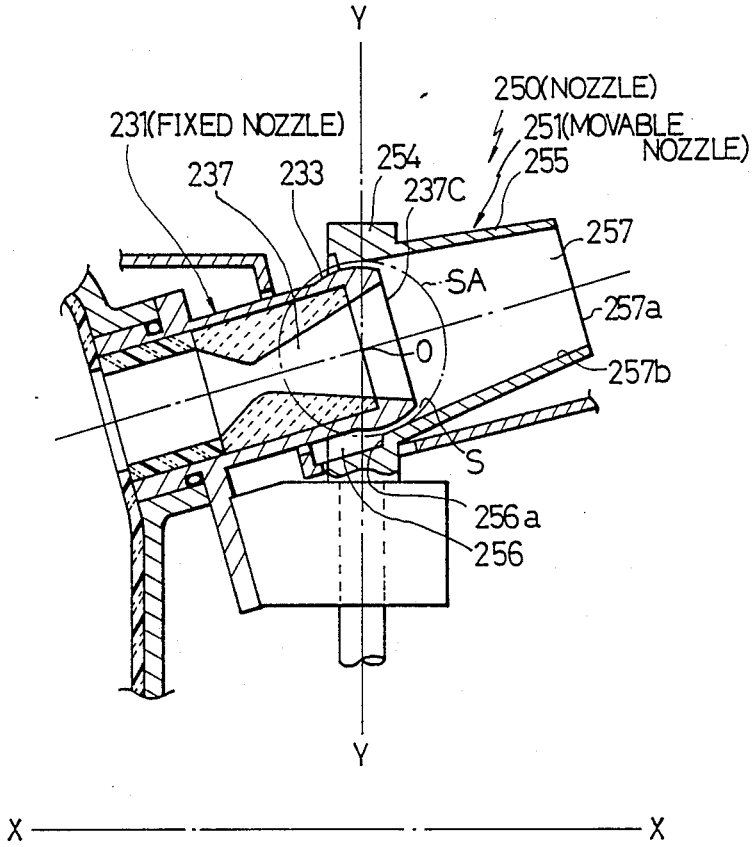
FIG. 7(B) is a similar cross-sectional view showing a second modification of the rocket nozzle incorporated in the control system according to the present invention.

FIG. 7(B) shows a second embodiment of the rocket nozzled 250 of the present invention, in which a conical movable nozzle 251 is used instead of the cylindrical movable nozzle 240. The nozzle body is formed with a base end portion 254, an extension portion 255, and an outlet end portion 257*a* to provide a convergent hole 257. In this embodiment, the diameter of the outlet end portion 257*a* of the movable convergent nozzle 251 is determined to be equal to or preferably a little smaller than that of an outlet end portion 237C of the divergent nozzle hole 237 of the fixed divergent nozzle 231. A phantom spherical surface SA with a central point O is formed a gap S away from the outer spherical portion 233 of the fixed divergent nozzle 231, and the inner circumferential wall surface 257*b* of the convergent nozzle hole 257 is brought into contact with the phantom spherical surface S.

In this embodiment, the deflection angle of the movable nozzle is not limited. Further, since the inner wall surface 257*b* of the divergent nozzle hole 257 covers the spherical portion 233 at the neutral or any deflected positions so as to converge the gas continuously, the overexpanded jet gas from the outlet end 237C of the fixed divergent nozzle 231 collides with the inner wall surface 257*b* without passing through a discontinuous portion. As a result, the pressure is not restored near the gap S and therefore the gas will not be leaked. The jet gas introduced into the nozzle body is gradually converged to the same outlet area as the initial jet area, being reflected within the convergent nozzle hole 257, and then jetted from the outlet end 257*a* of the movable nozzle body 251.

As a result of the observation by schilieren photographs, it has been verified that gas did not leak at all through the gap S when the nozzle was set to the neutral position and also deflected to about 12 degrees. Therefore, it is possible to prevent other elements from being damaged or contaminated by the gas leaked through the gap S between the fixed and movable nozzles of a rocket flying for many hours.

As described above, in the rocket nozzle including a fixed divergent nozzle and a movable nozzle according to the present invention, since the divergent nozzle is formed into an overexpansion type nozzle to drop the jet gas pressure near the nozzle outlet, it is possible to prevent the gas from leaking through the gap S formed between the two, fixed and movable, nozzles without contaminating other peripheral units. In addition, since the outlet diameters of the fixed divergent nozzle and the movable nozzle are equal to each other, it is possible to suppress a wasteful jet gas overexpansion without deteriorating the rocket nozzle performance.

What is claimed is:

1. A rocket flight direction control system for a rocket including a rocket body and a combustion chamber, said rocket flight direction control system comprising:

(a) steering wing means, pivotally attached to said rocket body, for controlling rocket flight directions;

(b) deflectable nozzle means, deflectively attached to said rocket body, for jetting combustion gas from said combustion chamber to generate rocket thrust, said deflectable nozzle means comprising;

(1) a fixed divergent nozzle of the overexpansion type, fixedly coupled to said combustion chamber, for expanding combustion gas; and (2) a movable nozzle, movably coupled to a rear end of said fixed divergent nozzle, for generating rocket thrust, an inner diameter of an outlet end of said fixed divergent nozzle being essentially equal to or slightly smaller than a diameter of an outlet end of said movable nozzle;

(c) control means, mounted in said rocket body, for generating steering control signals; and (d) actuating means, coupled to said steering wing means, said deflectable nozzle means and said control means, for actuating said deflectable nozzle means in response to said steering control signals in synchronism with steering motion of said steering wing means.

2. A rocket flight direction control system of claim 1, wherein said actuating means comprises:

(a) first actuating means for actuating said steering wing means in response to said steering control signals; and (b) second actuating means for actuating said deflectable nozzle means in response to said steering control signals in synchronism with steering motion of said steering wing means.

3. A rocket flight direction control system of claim 1, wherein said movable nozzle is movably coupled to said fixed divergent nozzle via a ball joint mechanism.

4. A rocket flight direction control system of claim 1, wherein said steering wing means is fixed to said movable nozzle to simultaneously actuate said steering wing means and said movable nozzle together by said actuating means.

5. A rocket flight direction control system of claim 1, wherein said movable nozzle is a cylindrical nozzle.

6. A rocket flight direction control system of claim 1, wherein said movable nozzle is a conical convergent nozzle.

* * * * *